US006383049B1

(12) United States Patent
Chun et al.

(10) Patent No.: US 6,383,049 B1
(45) Date of Patent: May 7, 2002

(54) METHOD FOR BONDING SUPPORTER OF SHADOW MASK IN FLAT CATHODE RAY TUBE

(75) Inventors: Hyun Tae Chun; Ju Hyeon Kim, both of Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/484,170

(22) Filed: Jan. 18, 2000

(30) Foreign Application Priority Data

Jan. 19, 1999 (KR) ..... 99-1492
Apr. 24, 1999 (KR) ..... 99-14754

(51) Int. Cl.[7] ..... H01J 9/14
(52) U.S. Cl. ..... 445/30; 65/43
(58) Field of Search ..... 445/30, 37; 65/43, 65/60.1

(56) References Cited

U.S. PATENT DOCUMENTS 4,923,422 A 5/1990 Capek et al. ..... 445/30

*Primary Examiner*—Kenneth J. Ramsey
*Assistant Examiner*—Joseph Williams
(74) *Attorney, Agent, or Firm*—Fleshner & Kim, LLP

(57) ABSTRACT

This invention is to bond a supporter of a shadow mask in a flat cathode ray tube to a panel. The method comprising the steps of: washing a rail, which is a supporter of a shadow mask, and a panel of the flat cathode my tube so as to remove impurities; arranging the rail at a certain position on the inner surface of the panel to place in an exact location; applying a predetermined pressure to the panel and the rail by a pressure device in stick closely; raising the temperature of the panel and the rail to a certain degree by a heating device; and applying a predetermined voltage to the panel and the rail so that the panel and the rail form a electrostatic field and are bonded by an electric bonding of the boundary surface. The above method simplifies the bonding process, reduces the size of the panel and prevent the pollution of the cathode ray tube, thereby providing reduced production cost and improved quality of the cathode ray tube.

20 Claims, 4 Drawing Sheets

METHOD FOR BONDING SUPPORTER OF SHADOW MASK IN FLAT CATHODE RAY TUBE

BACKGROUND OF THE INVENTION

1. Field of the Invention

The present invention relates to a flat cathode ray tube, and more particularly, to a method for bonding a rail, which supports and fixes a shadow mask inside a flat cathode ray tube, in an inner surface of a panel.

2. Background of the Prior Art

In general, a cathode ray tube is used to embody an image of an image display substantially. Recently, various cathode may tubes, which can remove the distortion of image, minimize the reflection by the external light and maximize the visible range, have been designed and commonly used.

As shown in FIG. 1, the flat cathode ray tube includes a panel 1 coated with a fluorescent material at the inner surface, a funnel 5 adhered on the inner periphery of the panel 1. And, a neck portion 5*a* formed at an end portion of the funnel 5 and has a electron gun 6 inserted therein for emitting electron beam with three colors, i.e., red, green and black colors, and a deflection yoke 7 arranged on the outer surface of the neck portion 5*a* for deflecting the electron beam in the horizontal and vertical direction.

The panel 1 includes a safety glass 2 fixed to the front surface of the panel 1 by a resin and maintaining the radiation width of the cathode ray tube, a rail connecting member 3 fixed on the inner surface of the panel 1, and a shadow mask 4 mounted on the rail assembly 3 for selecting the color of the electron beam.

The rail assembly 3 within the flat cathode ray tube is a frame member comprised of two long rails, two short rails and four end caps, which are connected with each other. The rails and end caps are formed by a presswork. The rail assembly 3 is used for supporting and keeping the shadow mask 4 at a proper interval from the inner surface of the panel 1. The rail assembly 3 (hereinafter called "rail") is bonded in the panel 1 by the coagulation force of a frit glass 8 inside a furnace.

FIG. 2 is a flow chart of conventional bonding process of the rail and panel disclosed in U.S. Pat. No. 4,923,422. Referring to FIG. 2, the bonding process of the rail and the panel will be described in detail.

First, a predetermined amount of frit powder and vehicle are missed in a predetermined ratio to manufacture a frit glass 8, and then, the rail 3 is washed to remove impurities from the surface of the frit glass 8.

After that, the frit glass 8 in a melted state fills space formed at the rear portion of the rail 3, and after placed on the inner surface of the panel 1, the rail 3 is adhered to the panel 1 by the coagulation force of the frit glass 8 inside the furnace.

After the bonding process of the rail 3 and the panel 1 is finished, an upper surface 3*a* of the adhered rail 3 is ground to maintain a distance between the inner surface of the panel 1 and the shadow mask 4 at a certain interval. The assembly of the panel 1 and the rail 3 is washed to remove grind chips produced during the grinding process.

After a black matrix and a fluorescent film is an formed on the inner surface of the panel 1, the shadow mask 4, which is in an tensioned state, is arranged on the ground upper surface 3*a* of the rail 3, which is bonded to the panel 1. The shadow mask 4 is fixed on the upper surface 3*a* of the rail 3 by a welding method in order to prevent thermal expansion of the shadow mask 4 by the electron beam.

The conventional bonding process is a basic process, which bonds the rail 3 to the panel 1, of a series of processes for manufacturing the flat cathode ray tube, and however, there are several problems as follows.

(a) The bonding process is very complicated and it takes lots of time to perform the work. That is, the conventional bonding process includes a adhering step using a adhesive such as the frit glass 8. Since the frit glass 8 is contracted to an extent of about 20–30% during the adhering step, a grinding step is required to maintain the certain interval between the inner surface of the panel 1 and the shadow mask 4;

(b) The size of the panel 1 is increased unnecessarily. The rail 3 must be designed to have a certain height to keep the distance between the panel 1 and the shadow mask 4 and a width to maintain the bonding force for standing the tension of the shadow mask 4. However, in the prior art, since the height of the rail is increased by the frit glass 8 which is additionally mounted to the rail 3, larger moment is added to the bonded portion under a certain tension. Therefore, the width of the rail 3 is still more increased to increase the bonding force and the increased width of the tail 3 increases the size of the panel 1. Additionally, because the frit glass 8 is flowed outside from the rail 3 during the adhering step and then coagulated, it occupies an unnecessary area on the inner surface of the panel, thereby increasing the size of the panel 1; and (c) The bonding process increases a badness rate and deteriorates the quality of the cathode ray tube.

As shown in FIG. 3, because the frit glass 8 used in the bonding process has a plurality of pores, foreign matters 9 such as fluorescent material used in a coating step intrudes into the pores and inserted into the bonded portions between the fit glass 8 and the panel 1 and between the frit glass 8 and the rail 3. Therefore, the foreign matters 9 fall off during a ventilating step for making the flat cathode ray tube in a vacuum condition, thereby resulting in stepping the shadow mask 4.

In addition, the frit glass 8 has residual gas therein generated during the bonding process, and the gas is discharged inside the cathode ray tube in a high vacuum condition, thereby polluting the cathode ray tube and deteriorating the quality thereof.

SUMMARY OF THE INVENTION

Accordingly, it is an object of the present invention to overcome the disadvantages in the prior art by providing a method for bonding a supporter of a shadow mask in a flat cathode ray tube, in which the supporter bonding process is simple and a work period of time is saved.

It is another object of the present invention to provide a method for bonding a supporter of a shadow mask in a flat cathode ray tube, in which the height of the supporter is increased at a minimum degree and the frit glass is not used on any area on the panel, so that the size of the panel can be reduced.

It is still another object of the present invention to providing a method for bonding a supporter of a shadow mask in a flat cathode ray tube, which excludes the intrusion of impurities and the production of gas, thereby improving the quality of the cathode ray tube.

The foregoing objects are accomplished in one embodiment by providing a method for bonding a supporter of a shadow mask in a flat cathode ray tube, the method comprising the steps of: washing a rail, which is a supporter of a shadow mask, and a panel of the flat cathode ray tube so as to remove impurities; arranging the rail at a certain position on the inner surface of the panel to place in an exact location; applying a predetermined pressure to the panel and the rail by a pressure device to stick closely; raising the temperature of the panel and the rail to a certain degree by a heating device; and applying a predetermined voltage to the panel and the rail so that the panel and the rail form a electrostatic field and are bonded by an electric bonding of the boundary surface.

The rail consists of iron(Fe) in a ratio of 60~75% by weight and chromium(Cr) in a ratio of 24~35% by weight, and the panel consists of sodium oxide($Na_2O$) and potassium oxide($K_2O$) with alkalinity in a ratio more than 6% by weight respectively.

It is preferable that the pressure applied to the panel and the rail during the bonding process is within a range of 1~10 $kgf/cm^2$ and the temperature of the panel and the rail is within a range of 100~520 degree.

Furthermore, it is preferable that the voltage applied to the panel and the rail is within a range of 200~4000V.

The bonded surface between the panel and the rail consists of metallic oxide layers with a thickness less than 2 $\mu$m, and the metallic oxide layer is comprised of at least one or of more ferric oxide, chronic oxide and manganese oxide.

In the meantime, preferably, the method for bonding the supporter of the shadow mask of the flat cathode ray tube further includes a step of forming a black film layer on the surface of the rail after the washing step.

The film layer forming step is either a step for oxidizing the rail at a certain temperature and gaseous state during a predetermined period of time or a step for depositing predetermined materials on the rail under the vacuum condition.

The method according to the present invention reduces the production cost of the cathode ray tube and improves the quality thereof.

BRIEF DESCRIPTION OF THE DRAWINGS

Understanding that these drawings depict only typical embodiments of the invention and are, therefore, not to be considered limiting of its scope, the invention will be described with additional specificity and detail through use of the accompanying drawings in which.

DETAILED DESCRIPTION OF THE PREFERRED EMBODIMENT

Figure 1:
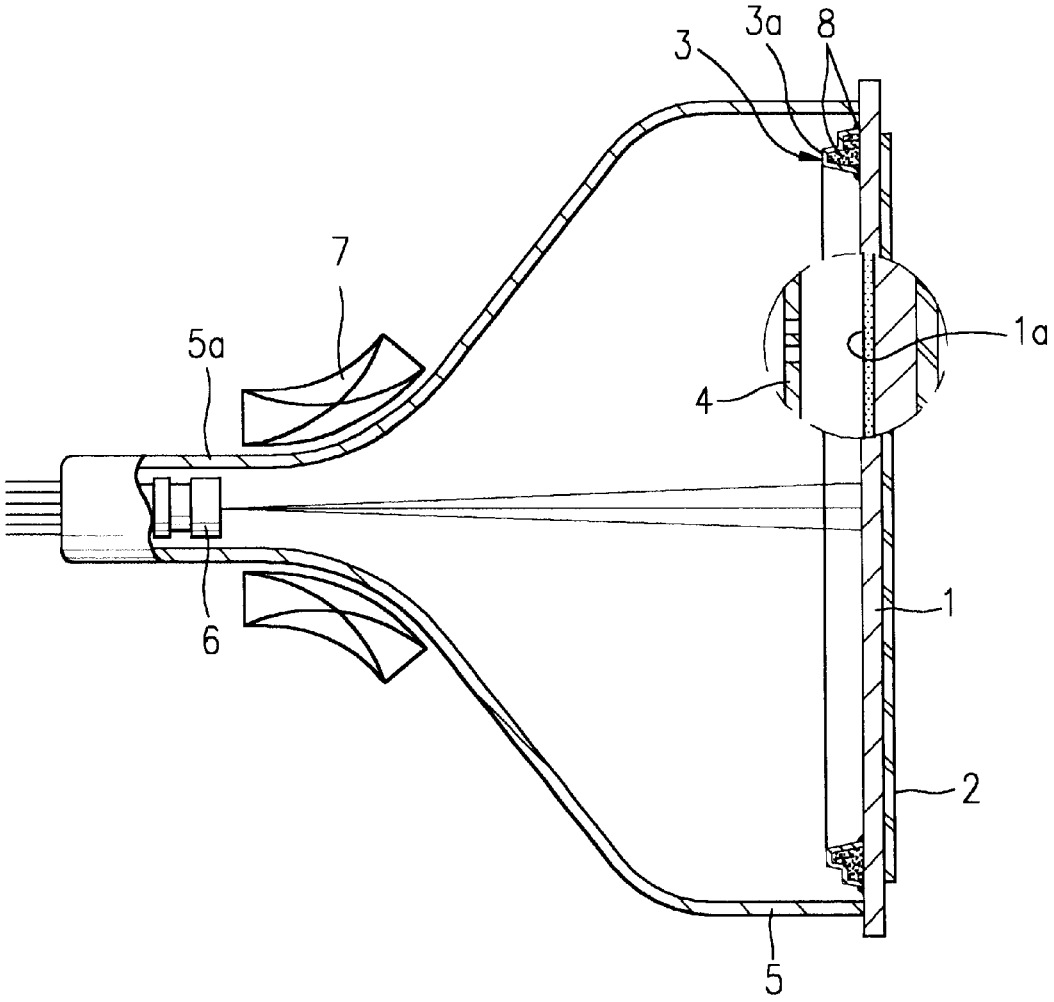
FIG. 1 Related Art
FIG. 1 is a longitudinal sectional view of a flat and colored cathode ray tube.
Figure 2:
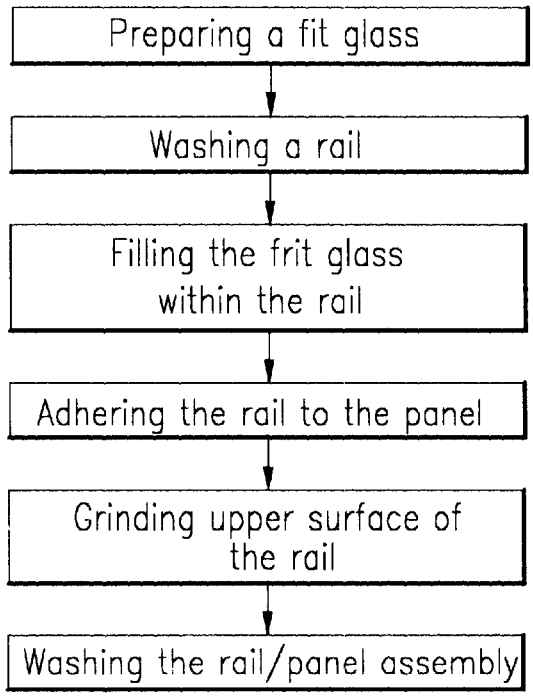
FIG. 2 Related Art
FIG. 2 is a flow chart of a bonding process of conventional rail and panel.
Figure 3:
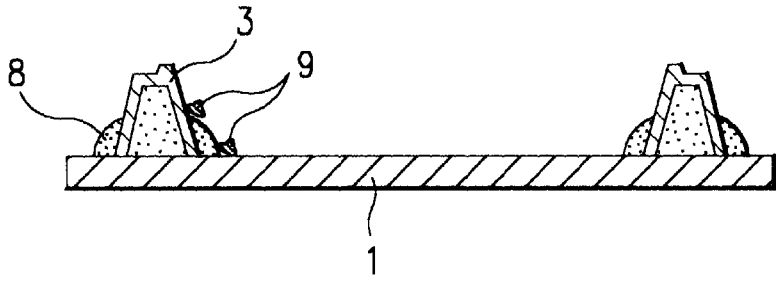
FIG. 3 Related Art
FIG. 3 is a schematic view illustrating an intrusion state of foreign material when the conventional rail and panel are bonded.

The present invention will be described in detail hereinafter with reference to the accompanying drawings, wherein the same reference characters designate corresponding parts throughout several views. It is to be understood that these drawings depict only typical embodiment of the invention and are, therefore, not to be considered limiting of its scope.

Figure 4:
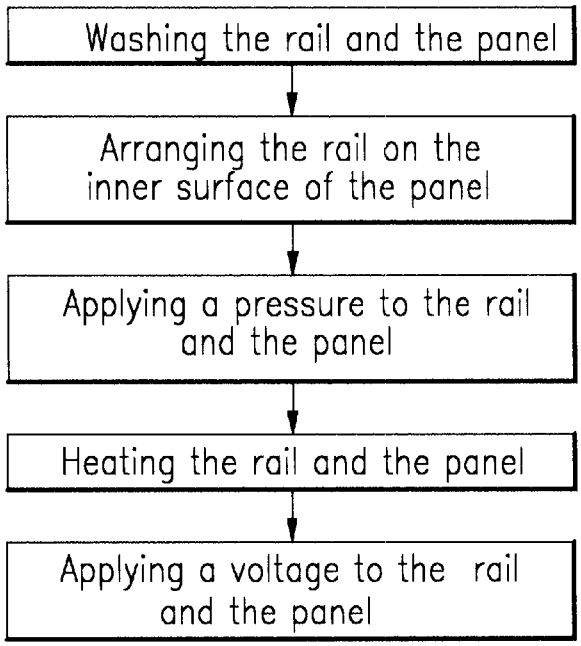
FIG. 4 is a flow chart of a bonding process according to a first embodiment of the present invention.
Figure 5:
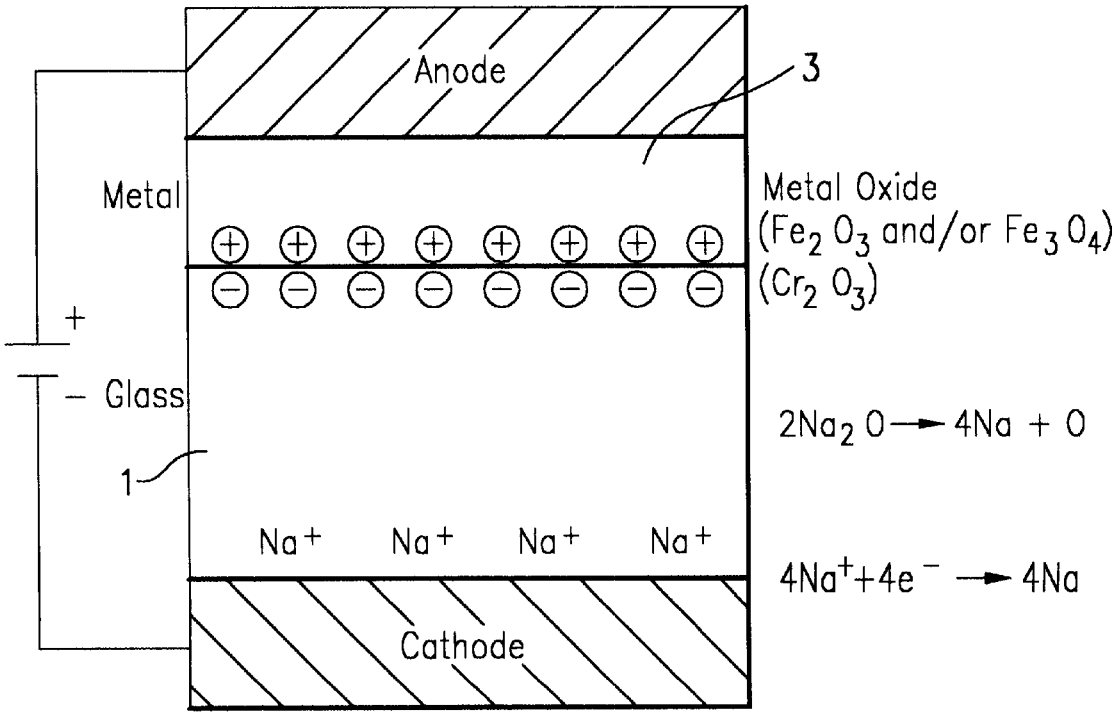
FIG. 5 is a schematic view illustrating reaction occurred on a bonded surface during the electrostatic bonding process.

FIG. 4 is a flow chart of an electrostatic bonding process according to the present invention, and FIG. 5 is a schematic view of reaction occurred on the bonded surface during the electrostatic bonding process. Referring to the drawings, a method for bonding a supporter of a shadow mask of a flat cathode ray tube will be described hereinafter.

In the present invention, the conventional bonding method, in which a rail 3 is adhered to a panel 1 by using a frit glass, is not used. This invention provides an electrostatic bonding method that an electrostatic field is formed using heat and voltage so as to adhere the rail made of metal to the panel 1 made of glass. Moreover, in this invention, an angle type member as the rail 3 is used in place of the conventional rail to solve the problems in the bonding process.

As shown in FIG. 4, the panel 1 and the rail 3 are washed with deionized water and acetone to remove impurities remaining on the surface thereof.

After the rail 3 is arranged on the inner surface of the panel 1 at an exact boding location, a certain pressure is applied to the panel 1 and the rail 3 by a pressure device. The pressurizing step is to improve the electrostatic bonding efficiency by removing fine pores formed due to a surface coarseness.

After that, the panel 1 and the rail 3 are heated up to a prescribe temperature by a heating device. In this step, as the temperature is increased, the bonding members, i.e., the rail 3 and the panel 1 perform a brisk electron movement, thereby improving an electric conductivity.

After performing the above preliminary steps, when a certain voltage is applied to the panel 1 and the rail 3, the electrostatic field is formed on the boundary surface between the panel 1 and the rail 3. The panel 1 and the rail 3 are bonded by an electric bonding force resulting from the electrostatic field.

FIG. 5 is a schematic view of a reaction on the boundary surface under the electrostatic field. Referring to FIG. 5, the electric bonding occurred by the reaction will be described in more detail.

In the increased temperature, when a cathode(−) voltage is applied to the panel 1 and an anode(+) voltage is applied to the rail 3, alkaline elements of components of the panel 1, for example sodium oxide($Na_2O$) is ionized.

The ionized sodium ion($Na^+$) moves toward the negative pole under the electrostatic field generated by the applied voltage, so that it is restored to sodium, and negative charge derived from the above moves to the boundary surface between the panel 1 and the rail 3. Also positive charge inside the rail 3 moves to the boundary surface between the panel 1 and the rail 3 under the influence of the electrostatic field.

Namely, The boundary surface between the rail 3 and the panel 1 is in lack of sodium ion, and thereby a strong static electricity is generated between the negative charge layer of the panel 1 and the positive change layer of the rail 3. The static electricity creates a strong electric bonding, so that the panel 1 and the rail 3 are bonded with each other.

Figure 6:
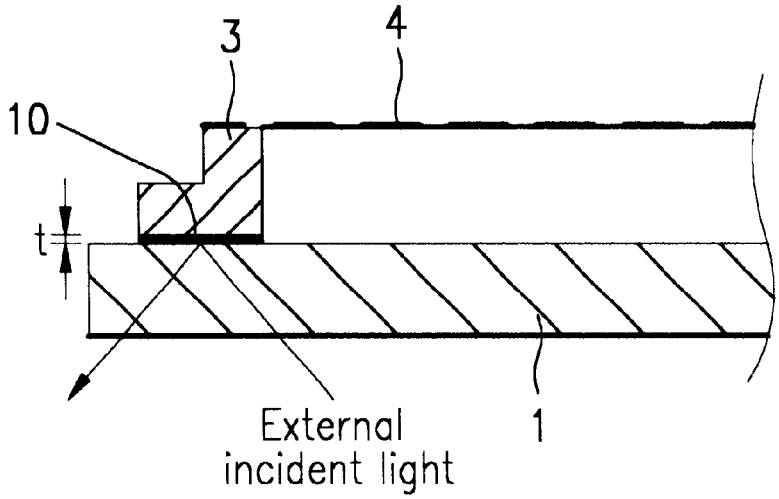
FIG. 6 is a sectional view of an assembly of the panel and the rail bonded according to the first embodiment of the present invention.

For more detail explanation, as shown in FIG. 6, the reactions of the moved negative and positive charges form a stable metallic oxide layer 10 on the boundary surface. The metallic oxide layer 10, which is physically adhered to the rail 3 and the panel 1, provides a strong bonding force to the panel 1 and the rail 3.

According to the present invention, the assembly of the panel 1 and the rail 3 is formed through the voltage applying step which is to substantially bond the panel 1 and the rail 3. Because the assembly is in a high temperature condition by the heating step, it is possible that the panel 1 is cracked by a thermal stress depending on a temperature grade when rapidly cooling.

Therefore, the panel 1 and the rail 3 are cooled in such a proper temperature grade that they are not cracked, and then the bonding process is finished.

In the first embodiment of the present invention, the panel 1 and the rail 3 have materials and conditions as follows.

The rail 3 is comprised of iron(Fe) in a ratio of 60–70% by weight and chromium(Cr) in a ratio of 24~35% by weight. The panel 1 is comprised of sodium oxide($Na_2O$), potassium oxide($K_2O$) and strontium oxide(SrO) which are alkalinity and in a ratio of 6~10% by weight respectively, silicon oxide($SiO_2$) in a ratio of 55~60% by weight, and other microelements. As previously described above, the electrostatic bonding can be made on the boundary surface between the panel 1 and the rail 3 by the alkaline elements contained in the panel 1.

It is preferable that the pressure is within a range of 1~10 $kgf/cm^2$ in order to touch the rail 3 and the panel 1 with each other to the maximum degree.

Furthermore, the temperature of the panel 1 and the rail 3 is preferably within a range of 100~520 degree during the bonding process to improve the electric conductivity and more preferably 300~520 degree. And, it is preferable that the applied voltage is within a range of 200~4000V.

In order to observe the efficiency of the bonded interface formed according to the bonding process, conditions and materials for bonding, a tension test and an interfacial analysis were performed on a specimen, which was taken from the assembly of the panel 1 and the rail 3, and a bonding strength and the constituents and thickness of the metallic oxide layer 10 were measured.

As a result of measuring the bonding strength, the bonding strength obtained up to a range of 10 $gf/cm^2$~200$kgf/cm^2$ depending to the conditions. The obtained bonding strength is a numerical value enough to bear the tension applied to a shadow mask 4.

As a result of measuring the metallic oxide, ferric oxide, chromium oxide and manganese oxide were detected depending on components of the rail 3. Therefore, it will be appreciated that all alloys using natural metals such as Manganese(Mn), Nickel(Ni), Molybdenum(Mo), or others can be applicable, and are not limited to the previously described constituents and constituent ratio of the rail 3.

Because the thickness(t) of the metallic oxide layer is less than 2 $\mu$m without regard to variation of the bonding condition, any variation of the set design value, namely, the height and width of the rail 3 is not occurred.

Additionally, even after finishing all processes for manufacturing the cathode ray tube, the impurities cannot intrude into the bonded interface and the production rate of gas is remarkably reduced in comparison with the frit glass.

In the assembly of the rail 3 and the panel 1 bonded according to the embodiment of the present invention, as shown in FIG. 6, the surface area of the rail 3 which is contact with the panel 1 is relatively increased in comparison with the conventional rail. The increased surface area increases the reflexibility by a metallic gloss and an external incident light of the surface of the rail 3 which is in contact with the panel 1, thereby reducing a user's recognition of images.

Therefore, in a second embodiment according to the present invention, the bonding process further includes a step for forming a black film layer on the surface of the rail 3 between the washing step and the pressurizing step, so that the rail 3 in itself can be absorb the external incident light.

Figure 7:
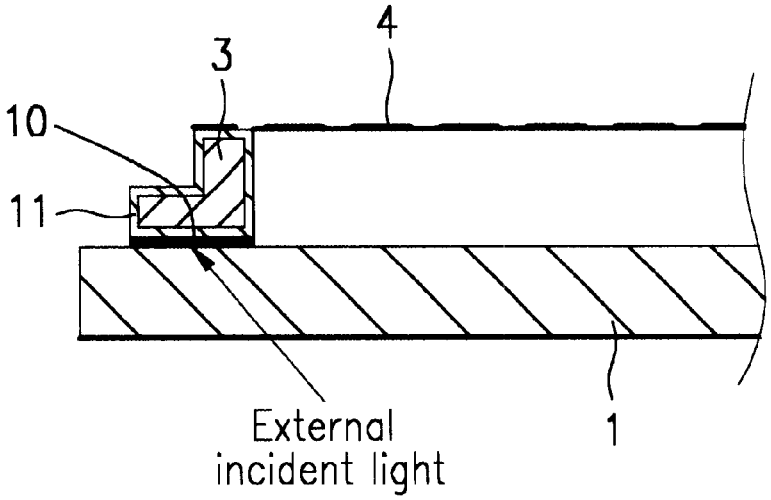
FIG. 7 is a sectional view of an assembly of the panel and the rail bonded according to a second embodiment of the present invention.

FIG. 7 is a sectional view of the assembly of the panel and the rail according to the second embodiment of the present invention. Referring to FIG. 7, the black film layer forming step will be described in more detail hereinafter.

The film layer 11 can be formed by an oxidation reaction of the surface of the rail 3 itself, particularly, by the oxidation reaction of the rail 3 under a predetermined temperature and gaseous state during a predetermined period of time. The film layer forming step by the oxidation reaction is performed after the washing step of the rail 3 and the panel 1, which are made of the same materials as those used in the first embodiment.

Preferably, the film layer forming step by the oxidation reaction is performed for 10~40 minutes under a condition than CO and $CO_2$ gas are generated due to a fuel combustion. At this time, the temperature is 600~700 degree.

As a result of the oxidation process, the film layer 11 of black ferric oxide($Fe_2O_3$) is formed on the surface of the rail 3.

The film layer 11 can be formed also through a process for coating certain materials on the rail 3, more particularly, through a process for heating the materials and depositing on the rail 3. The film layer forming step by the depositing process is also performed after the washing step of the rail 3 and the panel 1 which are made of the same materials as those used in the first embodiment.

In the adhering process, a sintered manganese oxide ($MnO_2$) is used as the coating material for the rail 3 and previously heated until the temperature is reaches a sublimation point from an initial vacuum degree of $10^{-4}$ Torr by a heat resistant method. The manganese oxide($MnO_2$) is deposited on the surface of the rail 3 and the black film layer 11 is formed on the surface of the rail 3.

After the film layer forming step is finished, the following steps for the electrostatic bonding of the rail 3 and the panel 1 are performed. However, since the steps are identical with the above embodiment, the explanation thereof is omitted.

The black film layer 11 improve a coarseness of the surface of the rail 3, thereby increasing the bonding force to the panel 1 and reducing an amount of reflection of the external incident light since it in itself absorbs the external incident light, as shown in FIG. 7.

As previously described above, the series of electrostatic bonding process according to the present invention simplifies the bonding process and reduces the work period of time. Furthermore, since the height of the rail 3 is increased at a minimum extent and the frit glass is not used, the size of the panel 1 is reduced. Additionally, the impurities are not inserted into the bonded interface and gas is not generated, thereby preventing the deterioration of the cathode ray tube and removing the cause of pollution.

Moreover, since the black film layer 11 formed on the surface of the rail 3 reduces the reflection of the external incident light and improves the coarseness of the surface, the efficiency of the electrostatic bonding is increased.

Therefore, the electrostatic bonding process according to the present invention provides reduced production cost and improved quality of the cathode ray tube.

Those skilled in the art will readily recognize that these and various other modifications and changes may be made to the present invention without strictly following the exemplary application illustrated and described herein, and without departing from the true spirit and scope of the present invention, which is set forth in the following claims.

What is claimed is:

1. A method for bonding a supporter of a shadow mask in a flat cathode ray tube, the method comprising the steps of:

washing a rail, which is a supporter of a shadow mask, and a panel of the flat cathode ray tube so as to remove impurities;

arranging the rail at a certain position on the inner surface of the panel to place in an exact location;

applying a predetermined pressure to the panel and the rail by a pressure device to stick closely;

raising the temperature of the panel and the rail to a certain degree by a heating device; and applying a predetermined voltage to the panel and the rail so that the panel and the rail form a electrostatic field and are bonded by an electric bond of the boundary surface.

2. A method for bonding a supporter of a shadow mask in a flat cathode ray tube as claimed in claim 1, wherein the rail is comprised of iron(Fe) in a ratio of 60~70% by weight and chromium(Cr) in a ratio of 24~35% by weight.

3. A method for bonding a supporter of a shadow mask in a flat cathode ray tube as claimed in claim 1, wherein the panel contains alkaline elements.

4. A method for bonding a supporter of a shadow mask in a flat cathode ray tube as claimed in claim 3, wherein the alkaline elements are sodium oxide($Na_2O$) and potassium oxide($K_2O$).

5. A method for bonding a supporter of a shadow mask in a flat cathode ray tube as claimed in claim 4, wherein the sodium oxide($Na_2O$) and potassium oxide($K_2O$) make up a ratio over 6% by weight of constituents of the panel.

6. A method for bonding a supporter of a shadow mask in a flat cathode ray tube as claimed in claim 1, wherein the pressure applied to the panel and the rail is within a range of 1~10 kgf/cm$^2$.

7. A method for bonding a supporter of a shadow mask in a flat cathode ray tube as claimed in claim 1, wherein the temperature of the heated panel and rail is within a range of 300~520 degree.

8. A method for bonding a supporter of a shadow mask in a flat cathode ray tube as claimed in claim 1, wherein the voltage applied to the panel and the rail is within a range of 200~4000V.

9. A method for bonding a supporter of a shadow mask in a flat cathode ray tube as claimed in claim 1, wherein the bonded interface of the panel and the rail is comprised of metallic oxide layer.

10. A method for bonding a supporter of a shadow mask in a flat cathode ray tube as claimed in claim 9, wherein the metallic oxide layer is at least one or more of ferric oxide, chromium oxide and manganese oxide.

11. A method for bonding a supporter of a shadow mask in a flat cathode ray tube as claimed in claim 10, wherein the metallic oxide layer has a thickness less than 2 $\mu$m.

12. A method for bonding a supporter of a shadow mask in a flat cathode ray tube as claimed in claim 1, further comprising a step of forming a black film layer on the surface of the rail after the washing step.

13. A method for bonding a supporter of a shadow mask in a flat cathode may tube as claimed in claim 12, wherein the film layer forming step is a process for oxidizing the rail under a certain temperature and gaseous state during a predetermined period of time.

14. A method for bonding a supporter of a shadow mask in a flat cathode ray tube as claimed in claim 12, wherein the gaseous state is formed by carbon monoxide(CO) and carbon dioxide($CO_2$).

15. A method for bonding a supporter of a shadow mask in a flat cathode ray tube as claimed in claim 13, wherein the temperature in the rail oxidizing step is within a range of 600~750 degree.

16. A method for bonding a supporter of a shadow mask in a flat cathode ray tube as claimed in claim 13, wherein the rail oxidizing step is performed for 10~40 minutes.

17. A method for bonding a supporter of a shadow mask in a flat cathode ray tube as claimed in claim 13, wherein the black film layer obtained through the oxidizing step is comprised of ferric oxide($Fe_2O_3$).

18. A method for bonding a supporter of a shadow mask in a flat cathode ray tube as claimed in claim 12, wherein the film layer forming step is a process for depositing a predetermined material on the rail under a vacuum condition.

19. A method for bonding a supporter of a shadow mask in a flat cathode ray tube as claimed in claim 18, wherein an initial vacuum degree of the depositing process is $10^{-4}$ Torr.

20. A method for bonding a supporter of a shadow mask in a flat cathode ray tube as claimed in claim 18, wherein the material for depositing is manganese oxide($MnO_2$).

* * * * *